United States Patent [19]

Magardo et al.

[11] 4,102,241

[45] Jul. 25, 1978

[54] HIGH-RATE-OF-FIRE RIFLE MECHANISM OR DUAL CYCLIC RATE MECHANISM

[75] Inventors: Robert F. Magardo, Harford County, Md.; Leonard R. Ambrosini, Scott County, Iowa; Raymond S. Isenson, Santa Barbara County, Calif.

[73] Assignee: The United States of America as represented by the Secretary of the Army, Washington, D.C.

[21] Appl. No.: 735,238

[22] Filed: Oct. 26, 1976

Related U.S. Application Data

[63] Continuation-in-part of Ser. No. 423,043, Dec. 7, 1973, abandoned.

[51] Int. Cl.[2] ..... F41D 9/06

[52] U.S. Cl. ..... 89/155

[58] Field of Search ..... 42/76 R; 89/155, 156, 89/157, 191 R, 193

[56] References Cited

U.S. PATENT DOCUMENTS

| | | | |
|---|---|---|---|
| 44,312 | 9/1864 | Hillis | 42/76 R |
| 368,924 | 8/1887 | Krieger | 42/76 R |
| 2,800,059 | 7/1957 | Miller | 89/193 |
| 2,976,770 | 3/1961 | Fletcher | 89/155 |
| 2,998,757 | 9/1961 | Herlach et al. | 89/155 |
| 3,788,191 | 1/1974 | Rose et al. | 89/155 |
| 3,817,148 | 6/1974 | Schirneker | 89/155 |

*Primary Examiner*—Stephen C. Bentley

*Attorney, Agent, or Firm*—Nathan Edelberg; Robert P. Gibson

[57] ABSTRACT

A rifle mechanism that will automatically fire, from a single barrel, a three-round burst at approximately 4,900 shots per minute (spm) without the use of a round counter, is disclosed. The rifle mechanism includes a cam and follower mechanism. The cam path controls the basic function of the rifle system to obtain the highest rate of fire with minimum operating rod velocities and to provide the ability to fire the three-round bursts without a round counter. The three rounds are loaded simultaneously into a chamber and the chamber is indexed to fire out each round before extraction. This eliminates the need for a full stroke cartridge handling mechanism.

1 Claim, 8 Drawing Figures

FIG. 1(a).
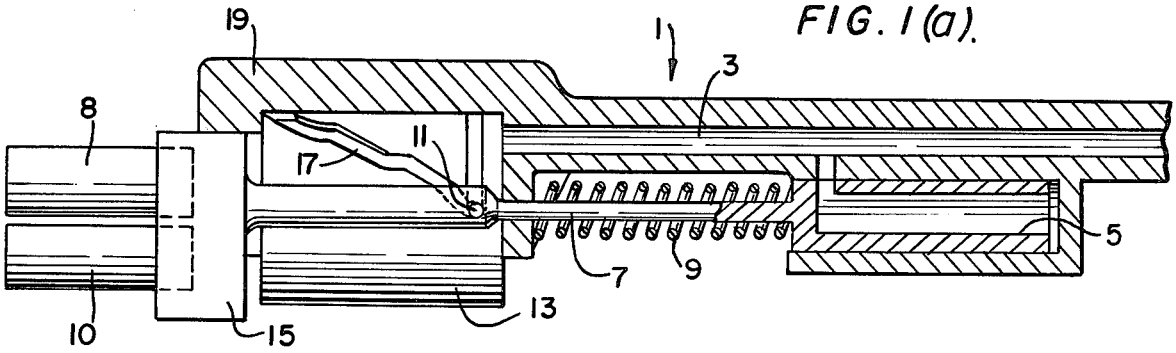
FIG. 2 (a).
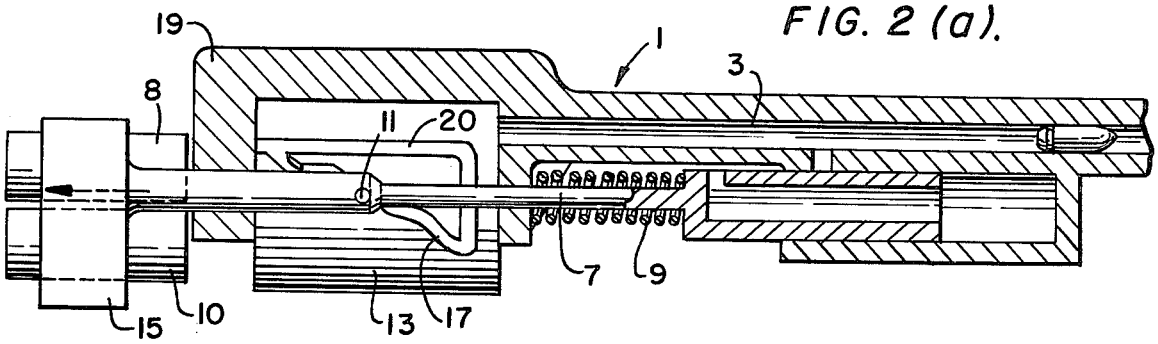
FIG. 3 (a).
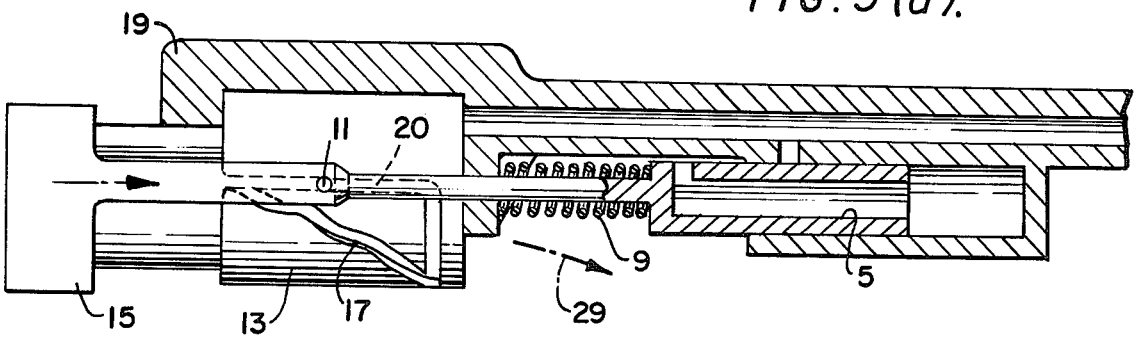
FIG. 2 (b).
FIG. 1(b).
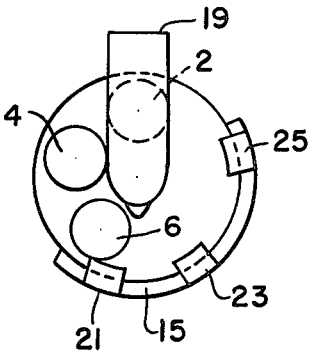
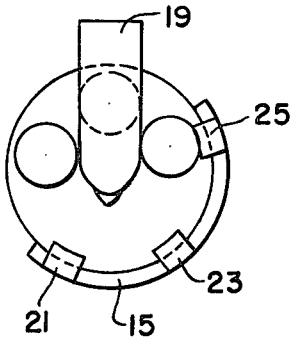
FIG. 3 (b).
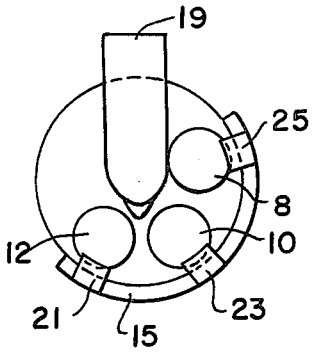

HIGH-RATE-OF-FIRE RIFLE MECHANISM OR DUAL CYCLIC RATE MECHANISM

The invention described herein may be manufactured, used, and licensed by or for the Government for Governmental purposes without the payment to us of any royalties thereon.

This is a continuation-in-part of our copending application, Ser. No. 423,043, filed Dec. 7, 1973 now abandoned.

BACKGROUND OF THE INVENTION

This invention relates to rifle mechanisms, and more particularly to a rifle mechanism capable of providing a high rate of fire.

Presently available automatic weapons designed and developed for military and individual use generally have firing rates in the range of 500 to 1,000 shorts per minute. There are, of course, weapons mechanisms which have normal rates of fire up to 2,500 shots per minute. As these mechanisms are pushed to higher cyclic rates, reliability and durability tend to fall off rapidly. When a round is fired in the prior art weapons, the moving elements must extract the empty case from the chamber, eject it and cock the hammer (if there is one) on the rearward stroke. The moving elements must also transfer energy to a storage device, usually a drive spring or buffer, and be brought to rest. On the forward stroke, a new round must be stripped from the magazine and chambered for firing.

For military rifle cartridges, the above-described sequence requires that the moving parts have average velocity of from ten to fifteen feet per second in order to provide cyclic rates of 1,500 to 2,000 shots per minute. Peak velocities may run several times higher than the average velocity, reaching forty to sixty feet per second in most weapons. At these high velocity rates, spring surging is a very serious concern and impact loads at these high velocities are very high. These high impact velocities produce stresses which may drastically shorten parts life.

There are, of course, high-rate-of-fire mechanisms known in the art. However, these weapons are generally multi-barreled weapons such as the Gatling gun which operate reliably at rates of fire of up to 6,000 shots per minute. These systems, because of the number of barrels and multiple bolt assemblies, are too heavy and bulky for use by the individual rifleman. High-rate-of-fire (2000 spm) rifle mechanisms that can provide a burst of three rounds or more have also been designed. Unfortunately, the current state-of-the-art requires that such weapons utilize a round counter mechanism that is connected to the trigger sear mechanism. The most successful weapon of this type (known to the inventors) utilizes a mechanism which is, for all practical purposes, as intricate as a clock mechanism. Such a mechanism is far too complicated expeditious field use and maintenance.

This invention solves the problem of obtaining a high rate of fire and a burst control mechanism with a minimum number of components.

SUMMARY OF THE INVENTION

The rifle mechanism of this invention provides a weapons system that will automatically fire, from a single barrel, a three-round burst at approximately 4,900 shots per minute. In the rifle mechanism of this invention, three rounds are loaded simultaneously into a chamber and fired at a high rate with but one push of the operating rod. At the end of the firing of three rounds, the empty cases are extracted and in the return stroke of the operating rod three more rounds are loaded and ready for the next trigger pull.

In the preferred embodiment, shown and described, the chambers are shown grouped in a cylinder which turns on its axis. The cylinder is serially indexed to fire out each round before the empty cases are extracted. This eliminates a need for a full-stroke cartridge handling mechanism. The elimination of the need for a full-stroke cartridge handling mechanism provides for a low velocity of the actuating rod, as compared to the actuating rod velocities of prior art rapid-fire rifle mechanisms.

The rifle mechanism of this invention includes a cam path formed on the surface of the cylinder which controls the basic function of the rifle system to obtain the high rate of fire with the minimum operating rod velocity.

The cam path also provided the ability to fire three rounds without a round counter. When the first round is fired, the operating rod begins its rearward movement and the cam path provides for rotation of the cylinder to place the next round in firing position. As the next round fires and the operating rod continues rearward, the cylinder rotates to the next position to fire the third and final round. After the third round is fired, the inertia of the operating rod continues to drive the follower in the cam path to rotate the cylinder to such a position that all chambers are exposed for extracting and for feeding the next three rounds. A return spring, which is compressed during the rearward operation of the operating rod, returns the operating rod for feeding and for positioning the first round in firing position. With the operating rod in its "in battery position", the weapon is again ready for firing. This single stroke of the operating rod for firing a burst of three rounds provides for a high rate of fire with but a minimum amount of movement of the components of the rifle mechanism and, therefore, a minimum amount of gun movement between shots. By minimizing the gun movement, projectile dispersion should provide for tighter target pattern per trigger pull.

It is therefore an object of this invention to provide a high-rate-of-fire rifle mechanism.

It is another object of this invention to provide a rifle mechanism that will automatically fire, from a single barrel, a burst of rounds at a high rate. It is a further object of this invention to provide a rifle mechanism that will automatically fire, from a single barrel, a three-round burst at approximately 4,900 shots per minute.

BRIEF DESCRIPTION OF THE DRAWING

The above mentioned and other objects of the invention will become readily apparent from the following detailed description when read in conjunction with annexed drawings in which:

FIG. 1*a* is a schematic representation of a preferred embodiment of the rifle mechanism of this invention showing the relationship of various parts of the mechanism after the first of three rounds has been fired;

FIG. 1*b* is an end view of the drum and rammer of the mechansim of FIG. 1*a* showing three rounds of ammunition in the three chambers provided in the drum with the first of the three rounds in the firing position;

FIG. 2*a* is another schematic representation of the preferred embodiment of the rifle mechanism of this invention showing the relationship of the various parts after the second of three rounds has been fired;

FIG. 2*b* is an end view of the drum and rammer of the mechanism of FIG. 2*a* showing the second of three rounds in the firing positions;

FIG. 3*a* is still another schematic representation of the preferred embodiment of the rifle mechanism of this invention showing the relationship of the various parts after the third round has been fired, with the cartridges being fed and the fired cases extracted;

FIG. 3*b* is an end view of the drum and rammer of the mechanism of FIG. 3*a* showing three new rounds in the three chambers provided in the drum;

DETAILED DESCRIPTION OF THE INVENTION

Figure 4:
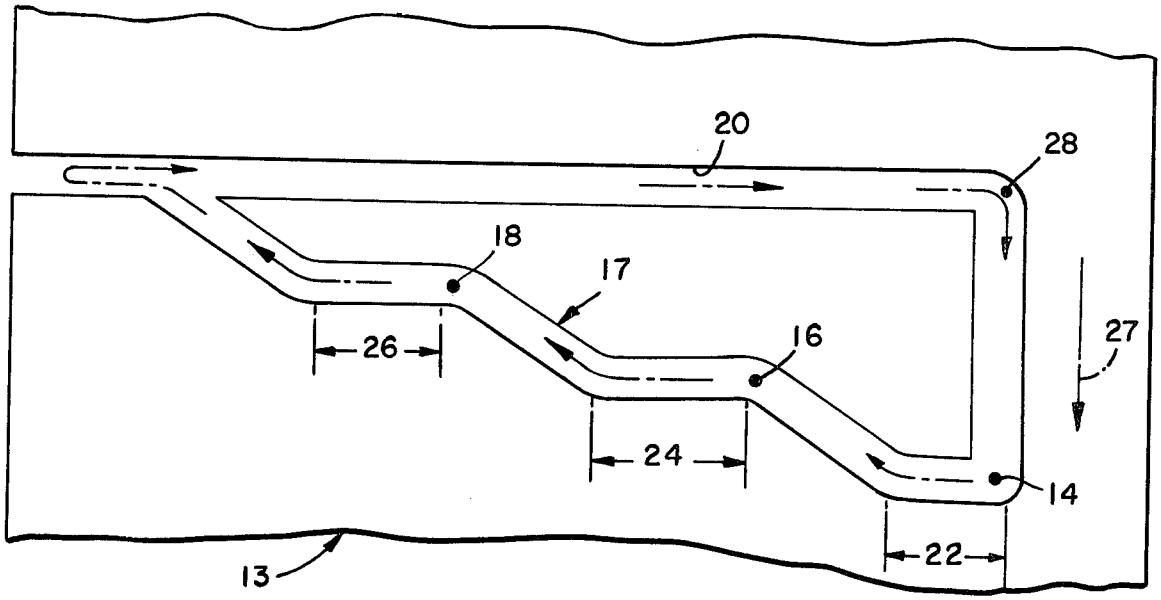
FIG. 4 shows a fragmentary view of the drum of the rifle mechanism of this invention and the cam path travel of the rifle mechanism of this invention.

Referring first to FIGS. 1*a*, 2*a*, and 3*a*, these figures show a rifle mechanism 1 having a barrel 3, a gas chamber or system 5, an operating rod 7, a follower 11, a cylindrical drum or revolver 13, a rammer 15, and a cam path 17 formed on the surface of the drum. A spring 9 surrounds operating rod 7, in the area shown. Rammer 15 is shown as integrally formed with operating rod 7. The firing mechanism (not shown) can be any suitable type known to those skilled in the art, such as a three-step hammer type or a type actuated by an electrical contract. All the components are housed to a receiver frame 19. Conventional means such as pins, screws and the like are used to secure the components to receiver frame 19.

Referring now to FIGS. 1*b*, 2*b*, and 3*b*, these figures all show end views of drum or revolver 13 and rammer 15. As shown in these figures, drum or revolver 13 is journaled for rotation about its longitudinal axis and has formed therein three chambers for receiving three rounds of ammunition, one in each chamber. In FIGS. 1*b*, and 2*b*, the three rounds of ammunition are the rounds 2, 4 and 6. In FIG. 3*b*, the three new rounds 8, 10 and 12 are shown. As shown in FIGS. 1*b*, 2*b* and 3*b*, rammer 15 has formed on the end thereof three tabs or right angle pieces 21, 23 and 25. FIG. 1*b* shows the first round, round 2, in the firing position and FIG. 2*b* shows the second round, round 4, of the three rounds in the firing position. FIG. 3*b*, on the other hand, shows three new rounds of ammunition in the three chambers at the time of feeding and extracting. Tabs 21, 23 and 25 are spring biased to engage behind the new rounds 8, 10 and 12.

Rounds 2, 4 and 6 are in their respective chambers in drum or revolver 13 and therefore are not visible in FIGS. 1*a* and 2*a*. However, FIG. 1*a* shows two of the three new rounds, rounds 8 and 10, in a ready position to be loaded into the three chambers in drum or revolver 13. In FIG. 3*a*, the new rounds 8, 10 and 12 are being fed into drum or revolver 13 and rounds 2, 4 and 6 are being ejected, as is shown in FIG. 3*b*.

Now that the structure of the rifle mechanism has been described, its operation for firing with a burst of three rounds will be described. The operation can thus be understood by referring to FIG. 4 in conjunction with FIGS. 1*a* and 1*b*, 2*a* and 2*b*, and 3*a* and 3*b*. Three rounds of ammunition, 2, 4 and 6, are loaded into the three chambers in drum or revolver 13 and the first round 2 is moved into the firing position shown in FIG. 1*b*. When the trigger of the rifle is squeezed, the firing mechanism is actuated, and round 2 is fired. When round 2 is fired, the gases developed travel down barrel 3 and into the gas system or chamber 5. The gas pressure pushes rearwardly on operating rod 7. FIG. 1 shows the rifle mechanism immediately after the firing of round 2. After the firing of round 2 there is a dwell time or period 22 in cam path 17. The dwell is needed to allow the pressure in the revolver chamber to drop to a pressure level not exceeding the rupture stress of the cartridge case prior to drum movement. During this period of time the cam path is essentially straight. Operating rod 7, under the influence of the gases, continues rearwardly. After dwell 22, the follower, now in the slope of the cam path as shown in FIG. 4, pushes or rotates the revolver or drum 13 in the direction of the arrows to the point 16. Point 16 is the point at which round 4 ignites. FIG. 2*b* shows round 4 in the firing position. After round 4 fires, the cam path has a second dwell time 24 and then, as shown in FIG. 4, the revolver or drum is rotated in the upward direction toward the point 18. During this travel, drum or revolver 13 is again rotated in the direction of arrow 27 so that round 6 will be brought into the firing position. At point 18, round 6 is fired. After round 6 has been fired, there is a third dwell time or period 26 in cam path 17. FIG. 2*a* shows the rifle mechanism immediately after the firing of round 6. Operating rod 7 continues to move rearwardly due to its inertia and the inertia of follower 11, rammer 15 and tabs 21, 23 and 25. The cam path travel is in the same direction until the top of the cam path is reached. This upper portion of the cam path is the return path 20, as is indicated by the reversal in the direction of the arrows. The return velocity of operating rod 7 is controlled by the compression of spring 9 as follower 11 moves down return path 20. As follower 11 moves into return path 20, drum or revolver 13 has again been rotated in the direction of arrow 27 to a point where all three chambers are exposed for feeding rounds 8, 10 and 12. As operating rod 7 moves forward, it carries with it rammer 15. This forward movement of rammer 15 pushes rounds 8, 10 and 12 into the three chambers in drum or revolver 13 by means of tabs 21, 23 and 25, as shown in FIG. 3*b*. When follower 11 travels the length of return path 20 and reaches point 28, shown in FIG. 4, the follower 11 stops and revolver 13 returns in battery position by means of a torsion spring, not shown. During the same time, drum or revolver 13 is again rotated in the direction of arrow 27 to bring round 8 into the firing position. Follower 11 is now in the area of cam travel path shown in FIG. 1*a* which is the dwell area 22 which includes the point 14. If the weapon is again fired, the cycle described above will be repeated firing rounds 8, 10 and 12.

Figure 5:
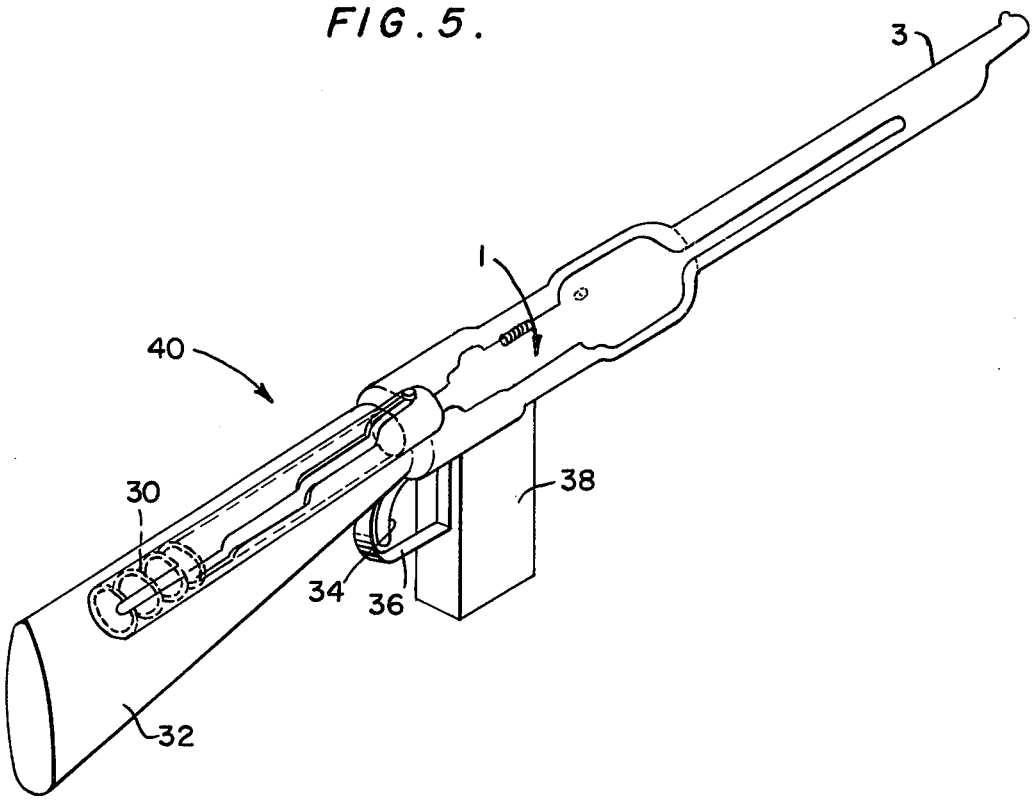
FIG. 5 is a pictorial showing of an actual rifle designed to incorporate the rifle mechanism of this invention.

As new rounds 8, 10 and 12 are moved into the three chambers in drum or revolver 13, these rounds push the expended rounds 2, 4 and 6 forward and out of the three chambers provided in drum or revolver 13. Th ejection path is indicated by the arrow 29 in FIG. 3*a*. Of course, as rounds 8, 10 and 12 move into the three chambers in drum or revolver 13, new rounds are placed in position for later feeding into the three chambers when rounds 8, 10 and 12 have been fired. any suitable mechanism can be used to move the new rounds into position FIGS. 1*a*, 2*a* and 3*a*, of course, just show the basic rifle mechanism. Before this mechanism can be put to practical use it has to be housed in a suitable rifle type housing. FIG. 5 shows rifle mechanism 1 housed in a suitable rifle housing 40. The complete rifle, of course, includes the rifle stock 32, a trigger 34, a firing mechanism (not shown), a trigger guard 36 and an ammunition clip or magazine 38. In addition to the basic rifle mechanism, a recoil mechanism 30 is also provided. Clip or magazine 38 is designed to carry a large number of rounds and permit feeding of three rounds at a time into the three chambers provided in the drum or revolver. FIG. 5 is given by way of example only in that rifle mechanism 1 can be housed in any suitable rifle housing. Furthermore, rifle mechanism 1 is not limited to use with rifles fired from the shoulder such as the type shown in FIG. 5, but can also be utilized with rifles fired from bipods or other types of conventional rifle mounts.

The rifle mechanism of this invention has been specifically described as providing a burst of three rounds. From the foregoing description of the invention, it should be obvious that rifle mechanism 1 can be designed to provide shot bursts of less than three or more than three shots. The number of shots in a burst is governed by the desired weight, size and complexity of a given weapon. Furthermore, the rifle mechanism of this invention is not limited to use with chambers arranged in a cylinder which turns on its axis, as shown in the drawings and described above. As an alternate, a sliding block chamber arrangement that could be made to slide laterally to position each chamber round in line with the axis of the barrel could also be utilized. Instead of revolving as the operating rod travels in the cam path, the sliding block would merely be caused to slide by the travel in the cam path. Mechanisms for providing such movement are, of course, well known in the art. In addition, the mechanism can be so arranged that the expended shells can be ejected rearwardly instead of in a forward direction. It should also be pointed out that either the telescope type ammunition or conventional ammunition can be utilized with the rifle mechanism of this invention. Of course, the movement of the operating rod and the loading and ejection mechanism will have to be designed specifically for the length of the ammunition utilized.

While the invention has been described with reference to a specific embodiment, it will be apparent to those skilled in the art, as mentioned above, that various modifications and changes can be made to the preferred embodiment shown and described without departing from the spirit and scope of the invention as set forth in the claims.

What is claimed is:

1. A high-rate-of-fire rifle mechanism comprising:

a single barrel;

a gas chamber;

a passageway between said gas chamber and said single barrel;

an operating rod having one end in communication with said gas chamber and a rammer integrally formed at its other end;

a return spring surrounding a portion of said operating rod;

a rotary cylindrical drum having three chambers, each chamber holding one round of ammunition for serial indexing in a firing position along said single barrel;

a trigger mechanism;

a cam path formed on the surface of said rotary cylindrical drum, whereby movement of said operating rod and follower effect rotation of said cylindrical drum;

a follower secured to said operating rod, said follower riding in said cam path;

means to provide three rounds of ammunition at a time for loading a round into each of said three chambers;

said cam path, said follower, said operating rod, said gas chamber, said cylindrical drum and said rammer effecting the firing of each of said three rounds in said three chambers in succession as a single burst, and loading of three new rounds in said three chambers while ejecting the said three fired rounds each time said trigger mechanism is activated, said operating rod making only one traverse rearward and back to its rest position each time three rounds of ammunition are fired and said follower making only one traverse of said cam path each time three rounds of ammunition are fired.

* * * * *